US005423439A

United States Patent [19]

Richter

[11] Patent Number: 5,423,439

[45] Date of Patent: Jun. 13, 1995

[54] REMOTE-CONTROLLED UNCOUPLING FOR ELECTRIC TOY AND MODEL TRAINS

[75] Inventor: Wolfgang Richter, Nuremberg, Germany

[73] Assignee: Ernst Paul Lehmann Patentwerk, Nuremberg, Germany

[21] Appl. No.: 190,819

[22] Filed: Feb. 2, 1994

[30] Foreign Application Priority Data

Feb. 3, 1993 [DE] Germany ..... 43 02 970.1

[51] Int. Cl.[6] ..... B61G 7/00

[52] U.S. Cl. ..... 213/75 TC; 213/211

[58] Field of Search ..... 213/75 TC, 211, 218, 213/165, 161, 159, 212

[56] References Cited

U.S. PATENT DOCUMENTS

| | | | |
|---|---|---|---|
| 2,261,258 | 11/1941 | Kinnear | 213/75 TC |
| 2,933,201 | 4/1960 | Anderson | 213/211 |
| 3,659,725 | 5/1972 | Passalacqua | 213/75 TC |
| 4,216,871 | 8/1980 | Rocereta | 213/75 TC |
| 4,219,123 | 8/1980 | Saeki | 213/211 |
| 4,228,907 | 10/1980 | Werner | 213/75 TC |
| 4,335,820 | 6/1982 | Gramera | 213/75 TC |

*Primary Examiner*—Mark Le
*Attorney, Agent, or Firm*—Jordan and Hamburg

[57] ABSTRACT

A remote-controlled uncoupling for an electric toy or model train with an electrically operated disengaging mechanism, particularly a hook coupling with coupling hooks, which can be pivoted about a horizontal axis and hooked into a coupling bracket of the respective counter-coupling part, wherein a response circuit, which emits a triggering signal for the disengaging mechanism whenever the train voltage is within a voltage gate, that is, between two threshold values for a specified time interval, is assigned to the electrically operated disengaging organ.

21 Claims, 2 Drawing Sheets

REMOTE-CONTROLLED UNCOUPLING FOR ELECTRIC TOY AND MODEL TRAINS

BACKGROUND OF THE INVENTION

The invention relates to a remote-controlled uncoupling for an electric toy or model train with an electrically operated disengaging mechanism, particularly a hook coupling with coupling hooks, which can be pivoted about a horizontal axis and hooked into a coupling bracket of the respective counter-coupling part.

Remote-controlled uncouplings for electrical toy and model trains have already been proposed in various embodiments. However, the construction of all of these known, remote-controlled uncouplings are very complicated. They depend, for example, on the use of high frequency signals or low frequency pulses and the evaluation of the signals or pulses in the equipment. As a rule, an additional voltage supply within the vehicle is even necessary. It requires special operating equipment on or next to the control console. Such equipment makes the uncoupling method even more complicated and expensive.

SUMMARY OF THE INVENTION

It is therefore an object of the invention to provide a remote-controlled uncoupling, which requires neither an additional voltage supply nor separate triggering elements and can thus be integrated immediately in existing train installations.

Pursuant to the present invention, this objective is accomplished for a remote-controlled uncoupling of the initially-named type by assigning to the electrically operated disengaging organ of the coupling a response circuit, which emits a triggering signal for the disengaging mechanism whenever the train voltage is within a voltage range, that is, between two specified threshold values for a specified time interval.

Due to the inventive construction of the uncoupling, it is thus merely necessary to turn the train voltage regulator into the specified range, that is, between two specified voltage values, and to hold it in this region for a specified time, in order to disengage the coupling.

In order to avoid interference with normal driving operation, for example, in the case that this range is frequently held in the driving operation for longer than the specified disengaging time period, provisions are made in a refinement of the invention to ensure that the voltage range lies in the voltage range below the motor driving voltage of the vehicle, especially the locomotive. In normal driving operation, the voltage regulator is never held in this range. Instead, the voltage regulator is turned from zero to at least the motor-starting voltage of the vehicle. Only at this voltage or at a higher one, can it happen that the voltage is left unchanged. However, if the range lies below the running voltage of the motor, an unwanted disengagement of the coupling can never occur during normal running operation. It is always necessary first of all to attenuate the running voltage controller below the starting voltage and to search for the voltage range in the range between this starting voltage and the switching-off position.

In order to be able to find this voltage range simply and reliably, an electrical position indicating element emitting a light or sound signal can be connected to the response circuit. Said electrical position indicating element generates a light or sound signal whenever the train voltage lies within the voltage range.

Conversely, however, if the range is placed so that it extends practically from zero up to the starting voltage of the vehicle, it is also possible to do without a system for recognizing the value set within the range, since such a value is reached automatically in this case when the vehicle comes to a stop. In this case then, the electrical position indicating element is designed so that the light or sound signal is emitted simultaneously with the triggering signal, that is, so that it is possible to recognize from the appearance of the light or sound signal that the coupling has been disengaged, so that, by turning the train regulator up again and, with that, restarting the vehicle, the disengaged vehicles can be separated from one another. Of course, this requires that the coupling, after being disengaged, remains unlocked for a period.

In the event that the inventive, remote-controlled uncoupling is used for a hook coupling, it has proven to be particularly advantageous to construct the coupling bracket of two superimposed parts, which can be shifted relative to one another. The obliquely rising trailing surfaces of the hooking legs form a continuous inclined plane in the uncoupling position and the disengaging mechanism averts the hooks and pushes the parts of the coupling bracket against one another.

Due to the inventive construction, it suffices to mount the inventive, remote-controlled uncoupling on only one of the coupling parts of two vehicles coupled together, preferably at the front and rear coupling part of a locomotive or of some other traction vehicle, so that only the coupling hook of the traction vehicle is swiveled out of the position, in which it is coupled with the counter-coupling part. The coupling hook of the counter-coupling part need not be swiveled at all into the opening position but, as a result of the shifting of the two parts of the coupling bracket as the vehicles move apart, necessarily slides down the thereby-formed continuous inclined plane of the mutually offset hooking legs and so reaches the uncoupling position.

Further advantages, characteristic features and details of the invention arise out of the following description of an embodiment and out of the accompanying drawings.

DESCRIPTION OF THE PREFERRED EMBODIMENTS

Figure 1:
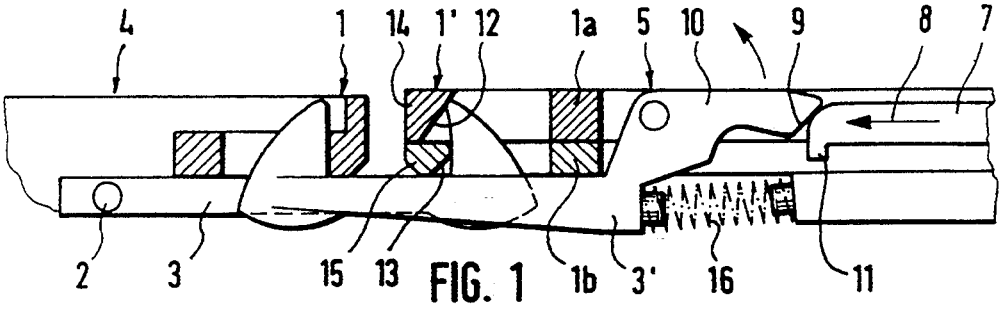
FIG. 1 shows a section through the coupling parts of two vehicles of an electric toy or model train that are coupled together, one of the coupling parts being designed for an inventive, remote-controlled disengagement, in the normal coupled position.

The hook coupling, shown in the Figures, comprises in a known manner a coupling bracket 1 or 1' and a coupling hook 3, which is mounted thereon so that it can pivot about a horizontal axis 2 and is subject to the action of a spring 16, the details of which are not shown in the left coupling part 4, which is mounted, for example, on a carriage. In the coupling part 5, which is shown on the right hand side of the Figures and which can be disposed front and back preferably on a traction vehicle, such as a locomotive, a somewhat different construction of the coupling bracket 1' as well as of the coupling hook 3' is provided for achieving the ability to uncouple by remote-controlled means.

Figure 2:
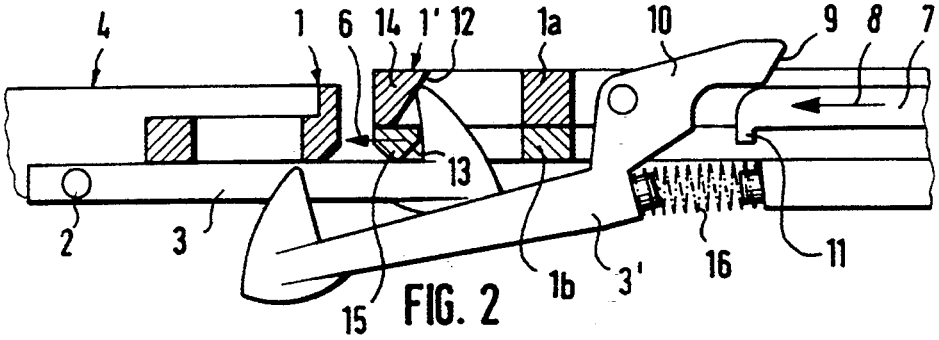
FIG. 2 shows a section, corresponding to that of FIG. 1, during the disengagement of the coupling hook by shifting a disengaging tappet.
Figure 3:
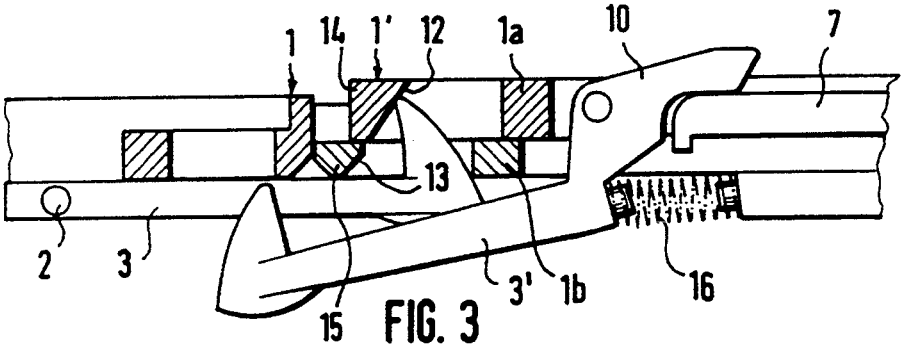
FIG. 3 shows a sectional diagram in which, in addition to the uncoupled coupling hooks, the two parts of the coupling bracket of the corresponding coupling part have been mutually shifted.
Figure 4:
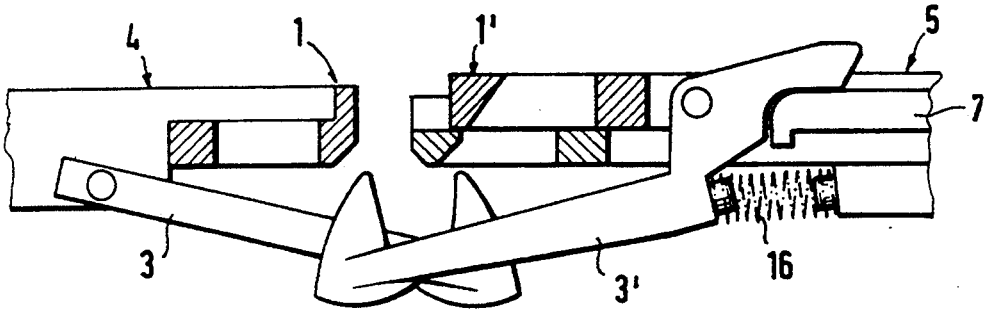
FIG. 4 shows a section through the coupling in the already pulled-apart position after one of the vehicles has started to move.
Figure 5:
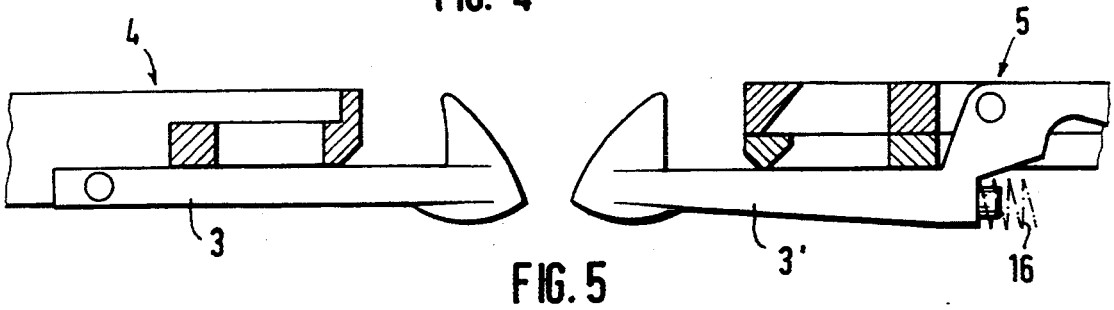
FIG. 5 shows a section through the coupling after the two vehicles have moved apart completely.

For example, the coupling bracket 1' is constructed from two superimposed parts 1*a* and 1*b*, which can be shifted relative to one another and of which the upper part la, at which the coupling bracket 3' is also mounted, is mounted immovably at the vehicle, while the part 1*b*, on the other hand, can be shifted from the normal coupling operating position of FIG. 1 and FIG. 5 in the direction of the arrow 6 in FIG. 2. As can be seen in FIGS. 2 and 3, the shifting takes place at the same time as or, optionally, somewhat staggered with the swiveling motion of the hook 3'. To disengage the coupling, a tappet 7 is shifted in the direction of arrow 8, so that, lying against an inclined plane 9 of an actuating leg 10 of the coupling hook, said tappet swivels this hook downwards into the opening position, so that it unhooks from the coupling bracket 1 of the counter-coupling part 4. At the same time or, as shown in the Figures, shortly afterwards, the tappet 7, with the help of the hook projection 11 engages, in a manner not shown, a continuation of the lower displaceable bracket part 1*b* and moves this into the uncoupling position of FIG. 3. In this position, the two obliquely rising trailing edges 12 and 13 of the hooking legs 14 and 15 of the coupling bracket parts la and 1*b* form a continuous inclined plane, so that, while the vehicles are being pulled apart as shown in FIG. 4, the coupling hook 3 of the coupling part 4, which, as such, is not affected at all by the remote-control, necessarily slides down the continuous inclined plane and thus also reaches the uncoupled position.

The unusual feature of the inventive actuating method of the remote-controlled uncoupling that is, the disengagement of the tappet 7, is not shown in the Figures, since it is strictly a matter of a circuit here, which could be constructed in different variations. The disengaging mechanism, for example, an electromotive driving mechanism or the like for actuating the tappet 7, is triggered by an evaluating circuit in the vehicle or carriage containing the coupling part 5, which gives a triggering signal for the electromotive driving mechanism when the train voltage at the vehicle, which can be supplied over rails or also an overhead line, is held for a predetermined period of time within a specific voltage range, that is, between two specified threshold values, which should, as far as possible, lie below the starting voltage of the vehicle. The generation of this triggering signal actuates the tappet 7. Of course, the uncoupling position must be maintained for a certain period of time, so that the possibility exists of moving the vehicles apart, as shown in FIGS. 4 and 5, by turning the train voltage regulator further, without the coupling hooks returning once again previously into the coupling position. Only after this specified period of time, when the electromotive driving mechanism or some other disengaging mechanism has ceased to act, can the spring 16 swivel the coupling hook 3' back into the starting position of FIGS. 1 and 5, while the coupling bracket part 1*b* is also moved back once again into the starting position of FIGS. 1 and 5, that is, into the normal coupling position by a further spring, which is not shown.

Figure 6:
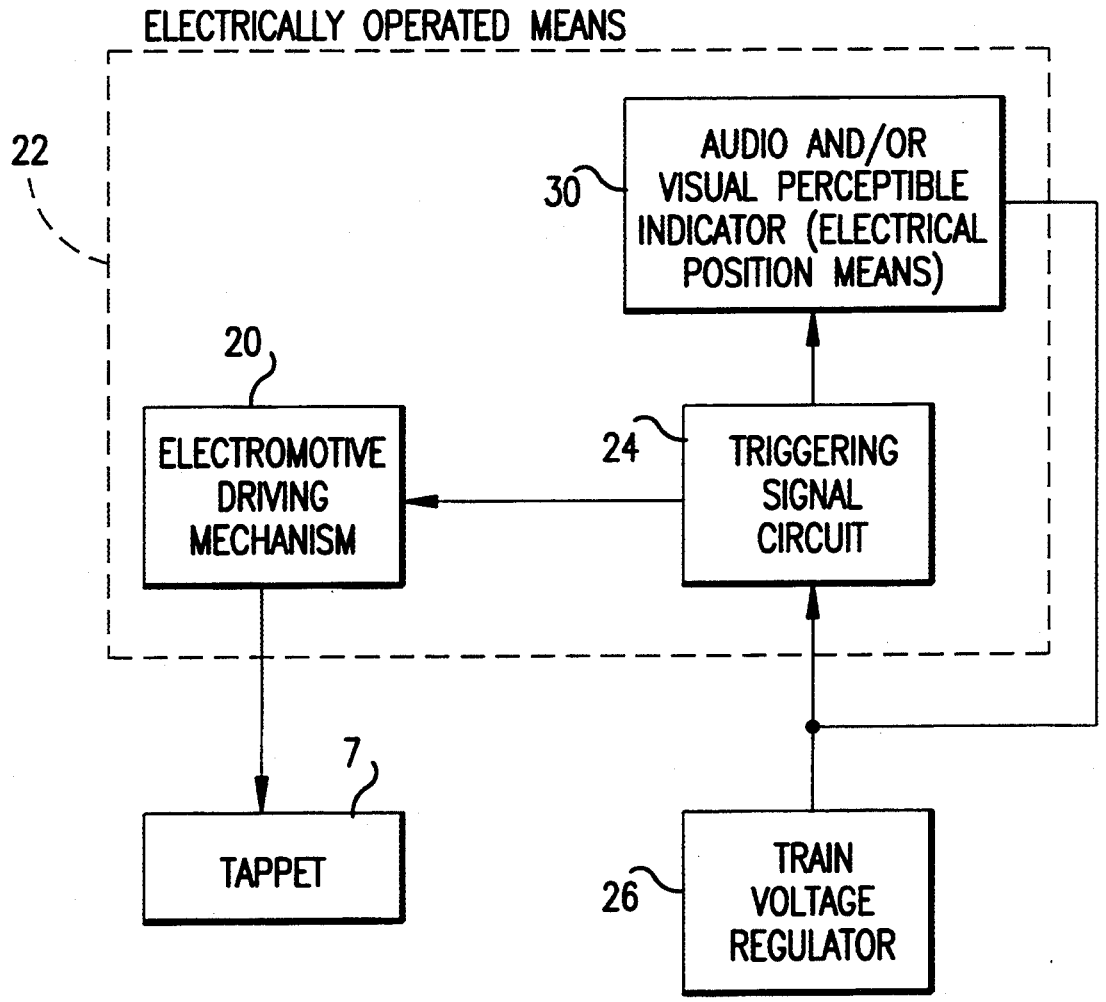
FIG. 6 is a circuit block diagram.

As shown in FIG. 6, the electrically operated means 22 includes the aforementioned electromotive driving mechanism 20 along with additional circuitry for actuating the electromotive driving mechanism 20. The additional circuitry includes a triggering signal circuit 24 that is supplied with voltage from the voltage regulator 26 of the train system and which produces a triggering signal when this voltage is within a voltage range which is less than the operating voltage for the train system. In addition, the triggering signal from triggering signal circuit 24 is supplied to an electrical position means 30 comprised of an audio and/or visual indicator and which provides an audio and/or visual indication of the voltage range or that the voltage is within the aforementioned disengaging range.

What I claim is:

1. A remote-controlled uncoupling for an electric toy train comprising first and second coupling means, said first coupling means comprising a pivotal coupling element pivotal between a coupled position in which said coupling element is coupled to said second coupling means and an uncoupled position in which said coupling element is uncoupled from said second coupling means, and electrically operated means for providing a triggering signal when the voltage for operating the electric toy train is within a voltage range between two threshold values for an elapsed period of time, said electrically operated means comprising actuating means actuated by said triggering signal for effecting pivoting of said coupling element from said coupled position to said uncoupled position to thereby effect uncoupling of said first coupling means from said second coupling means when said voltage is within said voltage range for said elapsed period of time.

2. A remote-controlled uncoupling according to claim 1 wherein the electric toy train is operable at an operating voltage, said voltage range being below said operating voltage.

3. A remote-controlled uncoupling according to claim 1 wherein said electrically operated means comprises an electrical position means for providing a perceptible indication when said voltage is in said voltage range.

4. A remote-controlled uncoupling according to claim 3 wherein said perceptible indication is selected from the group consisting of an audio indication and a visual indication.

5. A remote-controlled uncoupling according to claim 1 wherein said electrically operated means comprises an electrical position means for providing a perceptible indication when said triggering signal is produced.

6. A remote-controlled uncoupling according to claim 5 wherein said perceptible indication is selected from the group consisting of an audio indication and a visual indication.

7. A remote-controlled uncoupling according to claim 5 wherein said electrical position means simultaneously provides a visual indication and an audio indication when said triggering signal is produced.

8. A remote-controlled uncoupling according to claim 1 wherein said actuating means comprises an electromotive driving mechanism.

9. A remote-controlled uncoupling according to claim 1 wherein said first coupling means comprises a support structure, said pivotal coupling element being pivotally mounted on said support structure, said actuating means further comprising a slidable member slidable relative to said support structure between coupled and uncoupled positions, said slidable member when sliding from its coupled position to its uncoupled position effecting pivoting of said pivotal coupling element from its coupled position to its uncoupled position.

10. A remote-controlled uncoupling according to claim 9 wherein said slidable member is designated a first slidable member, said first coupling means further comprising a second slidable member slidable relative to said support structure, said second slidable member being slidable by said first slidable member from a coupled position to an uncoupled position, said second coupling means comprising a pivotal coupling claw pivotal between a coupled position and an uncoupled position, said pivotal coupling claw when in its coupled position engaging said support structure and said second slidable member, said second slidable member being operable to retain said pivotal coupling claw in its coupled position when said second slidable member is in its coupled position.

11. A remote-controlled uncoupling according to claim 10 wherein said first coupling means comprises biasing means biasing said pivotal coupling element toward its coupled position.

12. A remote-controlled uncoupling according to claim 10 wherein said first slidable member after sliding from its coupled position to its uncoupled position is further slidable from its uncoupled position to a third position, said first slidable member in sliding from its uncoupled position to its third position being operable to slide said second slidable member from its coupled position to its uncoupled position.

13. A remote-controlled uncoupling according to claim 10 wherein said support structure has a first oblique surface, said second slidable member having a second oblique surface, said first and second oblique surfaces being substantially coplanar when said second slidable member is in its uncoupled position, said first and second oblique surfaces being non-coplanar when said second slidable member is in its uncoupled position.

14. A remote-controlled uncoupling according to claim 13 wherein said pivotal coupling claw is juxtaposed to said first and second oblique surfaces when said second slidable member is in its coupled position and said pivotal coupling claw is in its coupled position.

15. A remote-controlled uncoupling according to claim 10 wherein said second slidable member is operable to release said pivotal coupling claw from its coupled position when said second slidable member is in its uncoupled position.

16. A remote-controlled uncoupling for a toy train comprising first and second coupling means, said first coupling means comprising a first pivotal coupling claw pivotal between a coupled position in which said first pivotal coupling claw is coupled to said second coupling means and an uncoupled position in which said first pivotal coupling claw is uncoupled from said second coupling means, operable means operable to effect pivoting of said first pivotal coupling claw from its coupled position to its uncoupled position to thereby effect uncoupling of said first coupling means from said second coupling means, said first coupling means comprising a support structure, said first pivotal coupling claw being pivotally mounted on said support structure, said operable means further comprising a first slidable member slidable relative to said support structure between coupled and uncoupled positions, said first slidable member when sliding from its coupled position to its uncoupled position effecting pivoting of said first pivotal coupling claw from its coupled position to its uncoupled position, said first coupling means further comprising a second slidable member slidable relative to said support structure, said second slidable member being slidable by said first slidable member from a coupled position to an uncoupled position, said second coupling means comprising a second pivotal coupling claw pivotal between a coupled position and an uncoupled position, said second pivotal coupling claw when in its coupled position engaging said support structure and said second slidable member, said second slidable member being operable to retain said second pivotal coupling claw in its coupled position when said second slidable member is in its coupled position.

17. A remote-controlled uncoupling according to claim 16 wherein said first slidable member after sliding from its coupled position to its uncoupled position is further slidable from its uncoupled position to a third position, said first slidable member in sliding from its uncoupled position to its third position being operable to slide said second slidable member from its coupled position to its uncoupled position.

18. A remote-controlled uncoupling according to claim 16 wherein said first coupling means further comprises biasing means biasing said first pivotal coupling claw toward its coupled position.

19. A remote-controlled uncoupling according to claim 16 wherein said second slidable member is operable to release said second pivotal coupling claw from its coupled position when said second slidable member is in its uncoupled position.

20. A remote-controlled uncoupling according to claim 16 wherein said support structure has a first oblique surface, said second slidable member having a second oblique surface, said first and second oblique surfaces being substantially coplanar when said second slidable member is in its uncoupled position, said first and second oblique surfaces being non-coplanar when said second slidable member is in its coupled position.

21. A remote-controlled uncoupling according to claim 20 wherein said second pivotal coupling claw is juxtaposed to said first and second oblique surfaces when said second slidable member is in its coupled position and said second pivotal coupling claw is in its coupled position.

* * * * *